United States Patent [19]

Cumpston

[11] Patent Number: 4,457,294

[45] Date of Patent: Jul. 3, 1984

[54] INLET AIR CONTROL FOR STOVE OR FURNACE

[76] Inventor: Edward H. Cumpston, 6 Stonehedge Dr., Bennington, Vt. 05201

[21] Appl. No.: 377,710

[22] Filed: May 13, 1982

Related U.S. Application Data

[63] Continuation-in-part of Ser. No. 280,290, Jul. 6, 1981, abandoned.

[51] Int. Cl.[3] ..... F24C 1/14; F16K 15/00

[52] U.S. Cl. ..... 126/77; 126/15 R; 126/112; 126/290; 137/504; 137/517

[58] Field of Search ..... 137/504, 517; 126/112, 126/15 R, 77, 290, 193, 146, 163 R

[56] References Cited

U.S. PATENT DOCUMENTS

| | | | |
|---|---|---|---|
| 366,324 | 7/1887 | Johnson | 126/15 R |
| 398,881 | 3/1889 | Colby | 137/517 |
| 767,636 | 8/1809 | Dietz | 126/112 |
| 784,334 | 3/1905 | Landrus | 126/112 |
| 892,033 | 6/1908 | Draper | 137/517 |
| 1,001,510 | 8/1911 | Curbey | 137/517 |
| 1,327,988 | 1/1920 | Dean | 126/77 |
| 2,022,143 | 11/1935 | Mottershall | 137/517 |
| 2,199,875 | 5/1940 | Brogden | 126/77 |
| 2,217,380 | 10/1940 | Pedder | 137/517 |
| 2,285,746 | 6/1942 | Sabins | 126/290 |
| 2,290,826 | 7/1942 | Sheu et al. | 126/15 R |
| 2,350,830 | 6/1944 | Scheu | 126/290 |
| 2,362,285 | 11/1944 | Mahlstedt | 126/290 |
| 2,514,838 | 7/1950 | Callahan | 137/517 |
| 2,526,346 | 10/1950 | Goldinger | 137/517 |
| 2,709,551 | 5/1955 | Bower | 126/77 |
| 2,750,936 | 6/1956 | Saito | 126/15 R |
| 2,790,603 | 4/1957 | Gramigna | 126/290 |
| 2,864,358 | 12/1958 | Harding | 126/15 R |
| 2,888,035 | 5/1959 | Thomas | 137/517 |
| 2,925,826 | 2/1960 | Streeter | 137/517 |
| 2,928,414 | 3/1960 | Streeter | 137/517 |
| 2,929,403 | 3/1960 | Streeter | 137/517 |
| 3,142,311 | 7/1964 | Lawrence | 137/517 |
| 3,143,135 | 8/1964 | Cornelius | 137/517 |
| 3,204,664 | 9/1965 | Gorchev | 137/517 |
| 3,331,389 | 7/1967 | Kirk | 137/517 |
| 3,565,105 | 2/1971 | Murakami | 137/504 |
| 3,763,884 | 10/1973 | Grassi | 137/517 |
| 3,794,077 | 2/1974 | Fanshier | 137/517 |
| 3,955,595 | 5/1976 | Modes | 137/517 |
| 4,180,051 | 12/1979 | Maier | 126/193 |
| 4,230,149 | 10/1980 | Worthen | 137/504 |
| 4,294,223 | 10/1981 | Montague | 126/112 |
| 4,306,538 | 12/1981 | Frieber | 126/290 |
| 4,306,585 | 12/1981 | Manos | 137/504 |
| 4,345,428 | 8/1982 | Cook | 137/517 |

*Primary Examiner*—Daniel J. O'Connor

*Attorney, Agent, or Firm*—Stonebraker, Shepard & Stephens

[57] ABSTRACT

A control regulates the rate of flow of combustion air flowing into an airtight stove or furnace10 containing a fire. A control element 15 or 45 is arranged in communication with the air inflow stream and moves in response to the velocity of the flowing air. The control element 15 or 45 moves to constrict the area of the inflow stream as air velocity increases and to open the area of the inflow stream as air velocity diminishes. Springs 25 and 26 or 60–62 bias the control element toward a maximum opening, and the spring bias is non-linear to provide increasing resistance to movement as the control element approaches a closed position. The spring bias system is preferably adjustable to vary the air inflow rate that is otherwise kept steady by the control element.

16 Claims, 8 Drawing Figures

INLET AIR CONTROL FOR STOVE OR FURNACE

RELATED APPLICATIONS

This application is a continuation-in-part of my parent application Ser. No. 280,290, filed July 6, 1981, entitled INLET AIR CONTROL FOR STOVE OR FURNACE, and abandoned upon the filing of this continuation-in-part application.

BACKGROUND

Controlling the flow of inlet combustion air to a furnace or stove is difficult, especially for hand fired stoves or furnaces burning solid fuels such as wood or coal. Too much combustion air makes the fire overheat and burn the fuel too rapidly, and too little combustion air can make the fire go out. A steady flow of combustion air is best for even burning and heating; but draft and fire conditions vary widely, making this difficult to attain.

Another problem with inlet air control is the possibility of a chimney fire. If chimney deposits ignite, the draft increases enormously. Air rushes in through the stove's inlet port to feed the fire in the chimney, which can be very dangerous indeed.

Present regulators for the flow of combustion air into hand fueled stoves and furnaces are generally bimetallic coils that operate a damper valve over the inlet air port. Bimetallic coils cannot be mounted in the fire box to respond directly to fire temperatures, because they cannot survive the heat and combustion products there; so they are mounted outside the fire box where they are slow to react to changes in fire conditions. They do not respond to the heat of a chimney fire, and they do not prevent chimney fires from burning out of control. They are also difficult to adjust to satisfactory operation and are often inaccurate.

Fire temperature has a predominant influence on the draft of hot air and gasses up the flue or chimney, and this in turn influences the inflow of combustion air. But other factors including outside air temperature, humidity, and wind velocity also have large and varying effects on the flue draft rate and the combustion air intake. Opening the door to the fire box quickly lowers the fire temperature and allows room air to escape up the flue. This practically stops the flow of air through the inlet port while the fire box door is open, and the cooler fire then needs more combustion air after the fire box door closes. Adding fresh fuel immediately cools the fire down and requires extra combustion air to get the new fuel burning. Many other variations occur from the quality and amount of fuel in the fire box, circulation of air around the fire box, and other variables. Bimetallic inlet air controllers respond only sluggishly to these conditions and tend to delay necessary corrections long beyond the needs of the fire. They are also unable to respond to a chimney fire.

I have devised a control that regulates inlet combustion air accurately, continuously, and responsively to the needs of the fire in a solid fuel stove or furnace. My device can be adjusted to maintain different burn rates and operates to compensate rapidly as fire and air flow conditions vary. By continuously regulating the rate of air inflow, my device prevents chimney fires from getting started by blocking the excess air flow that is required to let a chimney fire ignite and flame. My device is simple, inexpensive, mountable on a wide variety of stoves and furnaces with different inlet ports, and capable of operating reliably and effectively in controlling inlet combustion air.

SUMMARY OF THE INVENTION

My control continuously regulates the rate of flow of combustion air in a stream flowing into an airtight stove or furnace containing a fire. It includes a control element having a movable periphery arranged in communication with the air inflow stream so that the periphery moves toward and away from a fixed surface as a function of air velocity in the inflow stream. This constricts the area of the inflow stream in response to high velocity air flow and opens the area of the inflow stream in response to low velocity air flow. The control element's periphery is biased away from the fixed surface toward a maximum opening for the inflow stream, and the biasing is non-linear to provide increasing resistance as the periphery approaches the fixed surface. The biasing continuously maintains an approximately constant rate in the amount of air flow in the inflow stream, and the constant rate is preferably adjustable to different values. The result is continous and quickly responsive adjustments to supply a steady rate of air flow under varying conditions of fire and draft.

DRAWINGS

DETAILED DESCRIPTION

Although my inlet air control can be applied to a variety of stoves and furnaces including automatically fueled versions, it is especially beneficial for hand fueled stoves and furnaces that burn wood, coal, and other solid fuels. For convenience in the following description, all stoves and furnaces appropriate for use with my air control are collectively referred to as stove 10 having an inlet air port 11.

Figure 6:
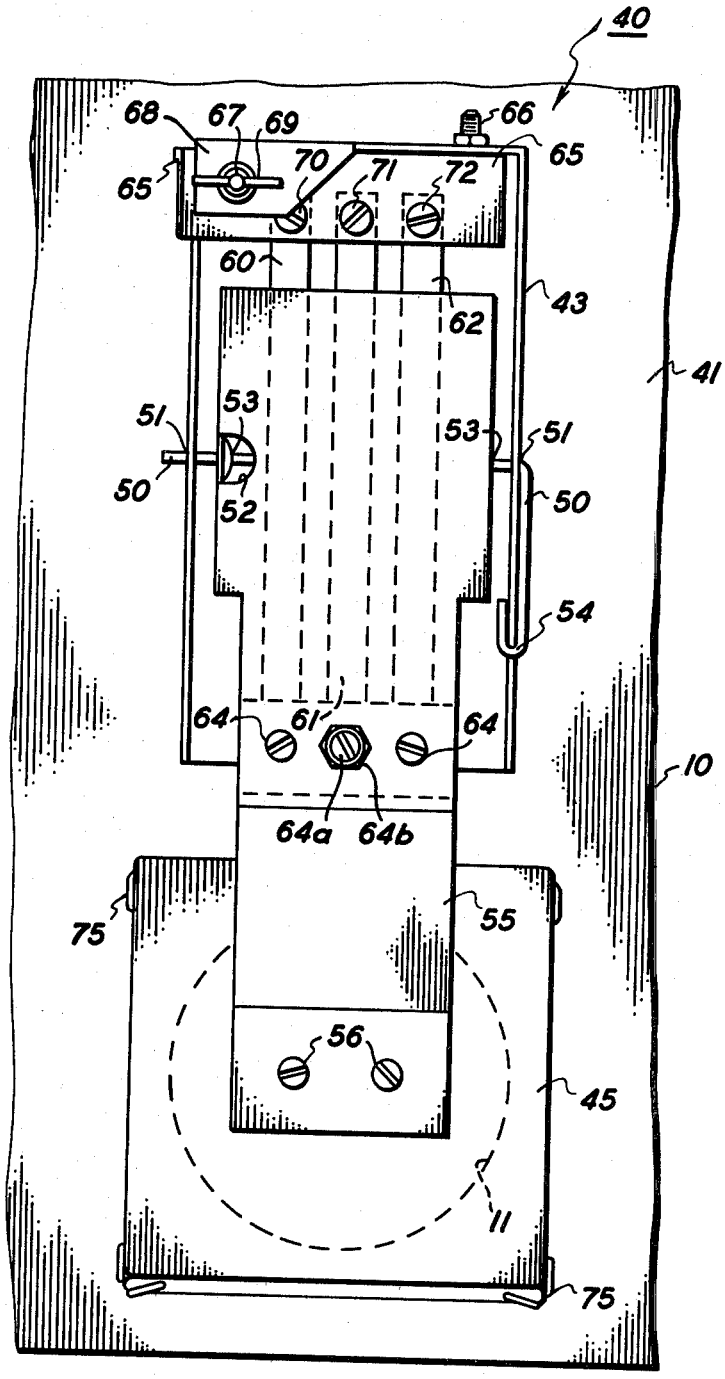
FIG. 6 is a front elevational view of another preferred embodiment of my inventive inlet air control.
Figure 7:
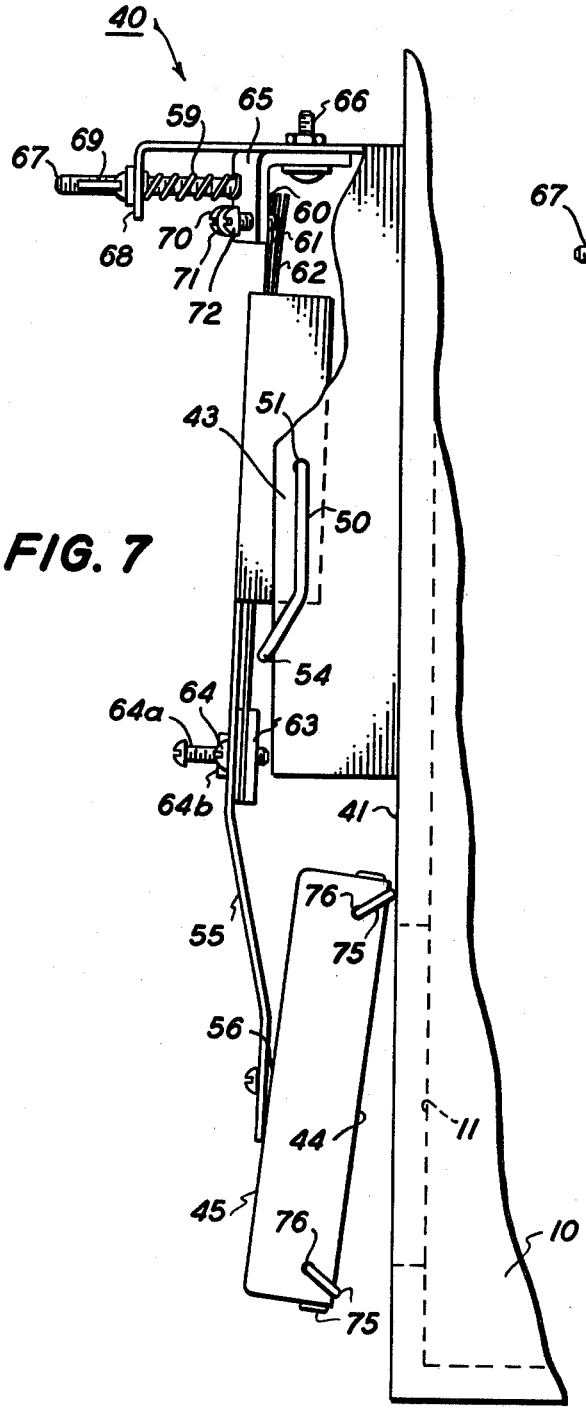
FIG. 7 is a partially cutaway, side elevational view of the control of FIG. 6.
Figure 8:
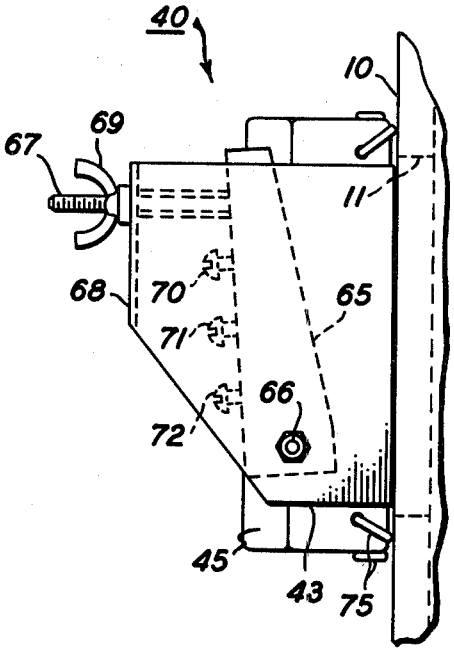
FIG. 8 is a top view of the control of FIGS. 6 and 7.

Since my parent application was filed, I have devised an improved version of my inlet air controller. It uses the same operating principles and achieves the same effect as the previously preferred embodiment of FIGS. 1–5; but its mechanical structure is simplified, made more compact, and less expensive. My new and now preferred embodiment is shown in FIGS. 6–8 and explained following the description of the earlier embodiment.

EMBODIMENT OF FIGS. 1–5

My air control uses a pair of opposed confronting surfaces arranged upstream of inlet port 11 so that one surface is fixed and the other is movable. Inlet air passes between these two surfaces with a velocity that responds to the needs of the fire and the other conditions affecting the draft. My device uses the pressure difference caused by the moving air to adjust the position of the movable surface to regulate the flow rate. Several requirements must be met to achieve this effectively as explained below.

Figure 4:
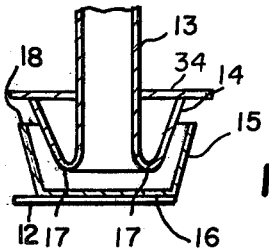
FIG. 4 is a fragmentary cross-sectional view of the air flow detection and control portion of the device of FIG. 1 in a wide open position.
Figure 5:
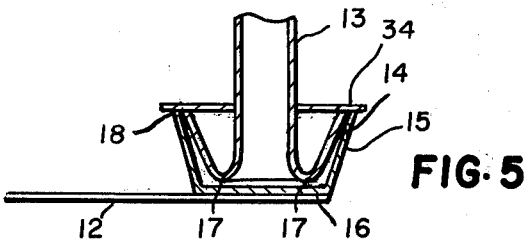
FIG. 5 is a fragmentary cross-sectional view similar to FIG. 4 but showing the air detection and control device in a closed position.

The shape for the fixed and movable control surfaces is generally conical as shown in FIGS. 4 and 5, but other shapes are possible. Fixed surface 14 can be formed as a convex, conical sleeve around pipe 13 leading into inlet port 11; and movable surface 15 can be formed as a concave, conical surface with a closed bottom 16 in a shape similar to a cup or saucepan. The outer rim 17 of surface 14 is preferably curved as illustrated so that air can flow smoothly around surface 14 and into pipe 13. Surfaces 14 and 15 are similarly shaped so as to nearly touch when closed together as shown in FIG. 5. Shapes other than conic or circular can also be used, and the fixed and movable surfaces can be interchanged in shape.

As surfaces 14 and 15 move from the closed position of FIG. 5 to the wide open position of FIG. 4, they separate by an increasing amount and enlarge the cross-sectional area of an annular passageway between the two surfaces. This enlarges the area of the flow of inlet air moving between surfaces 14 and 15 enroute to pipe 13. The velocity of the air in the flow affects the air pressure between surfaces 14 and 15; and as the air velocity increases, the pressure within the flow diminishes. Ambient atmosphere outside surface 15 then moves surface 15 against a spring bias toward surface 14 to a position where the inlet flow velocity and pressure balance with the spring bias and the ambient atmospheric pressure for positioning movable surface 15 relative to surface 14.

The outer rim 18, having the largest circumference of surface 15, is preferably spaced as close to surface 14 as any other portion of surface 15 to establish a minimum cross-sectional area of the annular flow between the two surfaces and serve as a detection and control element. This is preferred to having the minimal cross-sectional area for the flow occur between different diameters of movable surface 15 at different positions within the range of movement. The easiest way to achieve this is to make surface 15 slightly less tapered than surface 14 so that regions of surface 15 spaced from rim 18 are farther away from surface 14 and rim 18. Then the highest velocity air and lowest pressures occur in a region around rim 18, which also has the largest diameter and affords a substantial surface area for reacting to the air pressure difference and positioning surface 15 relative to surface 14.

The diameter of the annular flow between surfaces 14 and 15 is also substantially larger than the diameter of pipe 13. This not only provides a large peripheral extent of control surface around rim 18 for responding to air velocity and regulating air flow, but it also allows surface 15 to be positioned close to surface 14 and regulate a thin annular flow that can fill inlet port 11.

Movable surface 15 is pivotally mounted for low friction movement and is counterbalanced to be unaffected by gravity as explained more fully below so that surface 15 can be moved to different regulatory positions by the pressure difference between the atmosphere and the flow of air moving between surfaces 14 and 15. Springs explained below bias surface 15 toward the open position of FIG. 4 and offer increasing resistance against movement toward the closed position of FIG. 5 so that surface 15 moves lightly and easily near its open extreme in response to low velocity air and moves more firmly and slowly near its closed position in response to high velocity air.

Surface 15 has a range of motion adequate to enlarge the flow between surfaces 14 and 15 to an area that equals or slightly exceeds the area of inlet port 11. Proper sizes for inlet ports 11 are typically UL approved for different size stoves 10, and movable surface 15 opens widely enough to allow the full rated air flow through port 11.

The larger end of convex surface 14 preferably has a radial flange 34 providing a stop that rim 18 engages to limit the closed motion of surface 15 and shut off the inflow of combustion air as shown in the fully closed position of FIG. 5. This occurs occasionally during surges in the stove draft, although surface 15 does not maintain a closed position during operation.

The smallest flow area that surface 15 can constrict in response to maximum velocity inlet air should be exceeded by about ten times when surface 15 moves to the fully open position of FIG. 4. Also, when fully open, rim 18 of surface 15 must remain close enough to surface 14 so that it can respond to input air velocity increasing above a predetermined threshold to start moving surface 15 inward and control the air flow. This also requires that the flow passageway between surfaces 14 and 15 have a diameter substantially larger than inlet port 11 so that the flow can occur along a substantial surface length and vary within a small range of width to achieve the required differences in available flow area.

In operation, movable surface 15 is quick and responsive to changing conditions for the fire in stove 10. For example, a gust of wind quickly increasing the draft in the stove flue and causing a surge of input air also moves surface 15 briefly to the closed position of FIG. 5 to reduce the excess air flow. When the gust subsides, surface 15 moves back to a position responsive to steady input air flow at a lower velocity. Opening the fire box door greatly reduces the air flow into inlet port 11 and promptly moves surface 15 wide open. Adding fresh fuel to the fire cools the fire, reduces the draft, and opens surface 15 to enlarge the air flow area. This is appropriate for increasing combusiton air to ignite the new fuel and to compensate for the reduced draft from the lowered fire temperature. These adjustments can all occur long before any temperature change outside the stove can be sufficient to make bimetallic controllers respond. My control device tends to keep the flow rate of inlet combusition air constant for steady burning and heating even though fire temperature and draft conditions vary widely during stove operation.

My device also prevents chimney fires. If a chimney fire commences, it greatly increases the draft, drawing air into the stove and up the chimney at a high velocity. My controller will not allow any such excess inlet draft and limits the inlet air to rates that are insufficient to sustain a chimney fire. So although it may be possible to ignite chimney deposits, my controller will not allow excess air into the stove to permit a chimney fire to burn out of control.

If a stove is operated with an open door to the point of igniting a chimney fire, closing the door brings the inlet air under control of my device, which closes against the excessive draft and stays closed until the chimney fire extinguishes and the draft subsides enough to allow the controller to open and resume a steady rate of air supply.

Figure 1:
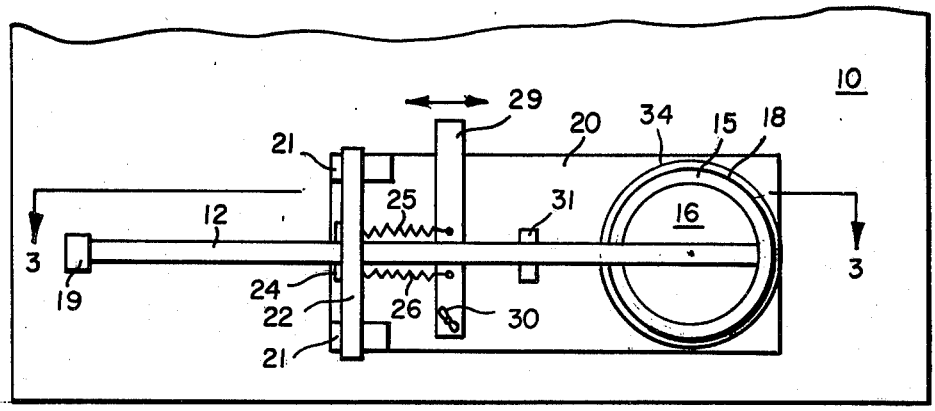
FIG. 1 is a partially schematic front elevational view of a preferred embodiment of my inlet air control.
Figure 2:
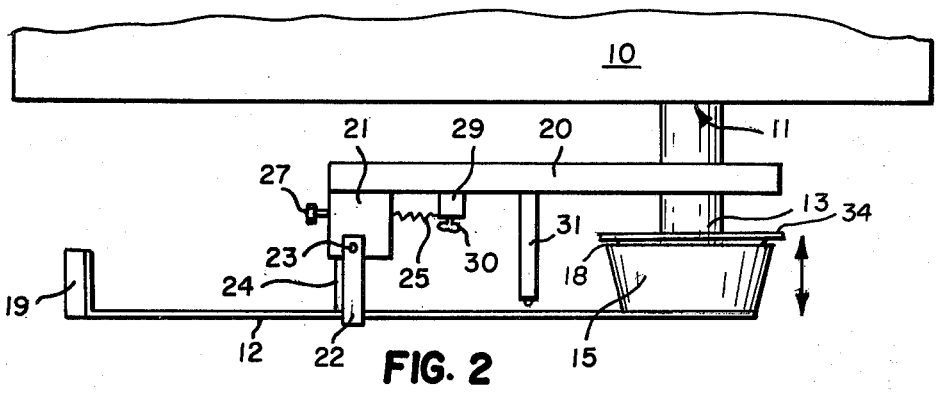
FIG. 2 is a plan view of the device of FIG. 1.
Figure 3:
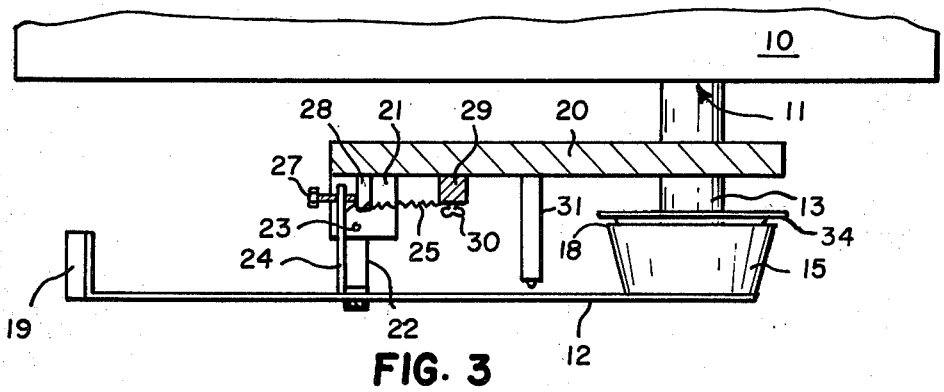
FIG. 3 is a cross-sectional view of the device of FIG. 1 taken along the line 3—3 thereof.

Preferred arrangements of mounting, spring biasing, and adjusting devices for surface 15 are shown in FIGS. 1–3. A mounting plate or bracket 20 is schematically shown as secured to pipe 13, but can also be fastened to stove 10 or mounted on a floor or other fixed structure near stove 10. It can have many forms besides the simple rectangle illustrated, and it can also be made of many materials that are preferably not combustible.

Movable surface 15 is mounted on one end of a support arm 12 that carries a counterbalance 19 at its other end so that pivoting of arm 12 and movement of surface 15 are not affected by gravity. This allows the control device to be mounted in any orientation for convenient adaptation to any inlet port 11.

Blocks 21 on bracket 20 support pivots 23 for a U-shaped cross arm 22 secured to pivot arm 12. A spring arm 24 extends from pivot arm 12 inward to the vicinity of the pivot axis between points 23 to support a pair of tension springs 25 and 26 that operate on a short lever-arm to bias the pivoting motion of arm 12 toward a wide open position. Two or more springs 25 and 26 are preferred for producing a non-linear spring bias that provides increasing resistance as pivotal motion approaches the closed position. Compression springs and leaf springs can be arranged to achieve the same non-linear effect, and a single leaf spring can do this by engaging a surface with an increasingly shorter spring arm as pivotal motion approaches closed.

A screw 27 threaded through spring support arm 24 provides an adjustable stop against an abutment 28 mounted on plate 20. This limits the wide open position of control surface 15 and insures that rim 18 does not swing so far away from surface 14 as to lose control.

Springs 25 and 26 are preferably adjustable so that the spring bias can be changed to adjust the burn rate of stove 10. Lessening the spring resistance decreases the combustion air flow rate and the stove temperature, and increasing spring resistance has the opposite effect.

There are many ways that spring resistance can be changed, but the illustrated arrangement is to anchor the fixed ends of springs 25 and 26 on a pivotally adjustable bar 29 that can be moved to change the spring tension and held in an adjusted position by wing nut 30. Springs 25 and 26 are preferably dimensioned so that one spring with a higher resistance to movement has little effect near the open end of the range and increasing effect toward the closed end of the range so that the other spring with a lighter resistance to movement predominantly biases surface 15 toward the open end of its range. Comparable arrangements can be made with compression springs and leaf springs to achieve a similar effect.

A bumper 31 mounted on plate 10 provides a resilient cushion reducing the sound and impact whenever a surge in the draft draws rim 18 to the closed position against flange 34. Bumper 31 can be a rubber stop and can be positioned in several places to cushion the closed limit of motion.

Many other mounting, pivoting, spring biasing, and adjusting devices are possible. Preferred arrangements make the device both responsive to and powered by the inlet air velocity, movable throughout the required range, with appropriate limits of motion and non-linear spring bias to operate correctly. Temperature adjsutment can be made by moving the mount or pivot point of the movable surface relative to the fixed one besides changing the spring bias as explained above.

EMBODIMENT OF FIGS. 6–8

Controller 40 of FIGS. 6–8 has a simplified form, but operates in the same general way as the controller of FIGS. 1–5. Instead of being counterbalanced, it is gravitationally suspended from a pivot; and its control element moves against a flat surface rather than a surface having a matching shape. Its non-linear spring bias is provided by leaf springs, and it is made more compact and simple. It operates in the same basic way, however, in responding to the velocity of inflowing air to control the combustion rate.

Mounting bracket 43 for controller 40 fastens to stove 10 either directly as illustrated or via any mounting plate that may be required to accommodate a configuration of inlet port 11. Bracket 43 is positioned directly above inlet port 11 to support vertical arm 55 holding control element 45 for movement over inlet port 11.

Control element 45 is cap-shaped and formed as a hollow square box as illustrated. It can also be rectangulr, circular, or have other shapes. It is preferably larger then inlet port 11 so that it engages the surface 41 of stove 10 surrounding port opening 11. Surface 41 is preferably a plane surface engaged by the peripheral open rim 44 of control element 45.

Control element 45 at the lower end of arm 55 is loosely mounted on support pins 56 so that it can move relative to arm 55. It can then self-align with surface 41 and bring its periphery 44 into even engagement with surface 41 as arm 55 moves angularly as explained more fully below.

Arm 55 is supported for vertical pivotal movement on bracket 43 by a pin 50 that provides a horizontal pivot. Pin 50 extends through a pair of horizontally aligned holes 51 in bracket 43 and a corresponding pairof horizontally aligned holes 53 in arm 55. An opening 52 in arm 55 affords visual access for inserting pin 50 through arm 55, and a U-bend 54 at one end of pin 50 engages an edge of bracket 43 for holding pin 50 in its mounted position. Pivoting U-bend 54 away from the edge of bracket 43 allows withdrawal of pin 50 and removal of arm 55 from bracket 43.

Three leaf springs 60–62 provide non-linear bias for arm 55 and control element 45. Bar 63 and screws 64 fasten leaf springs 60–62 to arm 55 below pivot pin 50, and the springs extend vertically upward to their free ends near the top of bracket 43. Springs 60–62 then move with arm 55 as element 45 swings open and closed.

Springs 60–62 provide non-linear bias for arm 55 as their free ends engage adjustment screws 70–72 at different points in the range of movement of arm 55. Screws 70–72 are individually adjustable for determining the bias applied by each spring and are also adjustable as a group to change the continuous air flow rate as explained below.

Spring adjustment screws 70–72 are threaded through a control arm 65 mounted on pivot screw 66 at the top of bracket 43. The ends of screws 70–72 engage respective springs 60–62 for determining the position where each spring engages an adjusting screw. One of the springs 60–62, preferably the far left spring 60, engages an adjustment screw 70 positioned so that spring 60 biases arm 55 throughout its range of travel all the way to the maximum opening. This provides a light bias near the open position. The other springs 61 and 62 engage adjustment screws 71 and 72 set at different positions to bias arm 55 in different regions in the vicinity of its closed position where periphery 44 engages fixed surface 41. As arm 55 moves toward large opening positions, springs 61 and 62 disengage from adjustment screws 71 and 72, leaving only the bias of spring 60. Conversely, as arm 55 moves toward a closed position, it picks up additional bias from springs 61 and 62. This arrangement provides a non-linear bias that is lightly resilient when arm 55 is near a fully open position and becomes increasingly stiff in resisting movement of arm 55 toward a closed position.

Springs 60–62 can be uniformly resilient and differ only in operating range or can also differ in stiffness so that stiffer springs resist closure of control element 45. Different numbers of springs can also be used, and the operating zones for different springs can be arranged in different ways.

The pivotal mounting of control arm 65 on bracket 43 allows angular adjustment of screws 70–72 to change the limits of movement of the upper ends of springs 60–62 and thereby adjust the rate of air inflow. This is done with an adjustment screw 67 extending from arm 65 through an outer lip 68 of bracket 43 engaged by wing nut 69 on screw 67. A spring 59 surrounding screw 67 and trapped between control arm 65 and lip 68 holds an adjusted position set by wing nut 69, and the head of screw 67 is prevented from turning relative to bracket 65. This can be done by grinding a flat side on the head of screw 67 to rest against bracket 65 in a way that prevents rotation, but other measures can also be used.

Screwing wing nut 69 in and out relative to lip 68 then adjusts the angular position of control arm 65 and the positions of spring adjustment screws 70–72. These maintain their interrelationship while moving with control arm 65 to change the regions where they engage the upper ends of springs 60–62. This changes the spring bias applied at different rotational positions of arm 55 to adjust the bias toward more open or closed positions. Preferably the spring 60 that biases the full range of movement for arm 55 is furthest from pivot screw 66 so that adjusting control arm 65 moves the light, open bias a little more than the additional constricted bias. Adjustment of wing nut 69 to move arm 65 controls the air inflow rate, the burn rate, and the rate of heat output from stove 10 as required.

Central spring 61 is fastened to arm 55 with a longer screw **64*a* and a nut 64*b*. This makes screw 64*a* extend outward to serve as a hook on which a weight can be hung to close element 45 when stove 10** is not in use.

Control element 45 has a cushion preventing a clapping sound when it moves to a closed position with its periphery 44 engaging surface 41. Many different cushioning arrangements may work for this purpose, but the presently preferred arrangement is a cushion string 75 threaded through corner holes in element 45 as illustrated. A single length of string 75 can be threaded through each of a pair of corner holes 76 to extend around the inside periphery of control element 45 and be looped around each corner as illustrated. Cushion string 75 then engages the surface of mounting plate 41 at each corner of control element 45 before rim 44 closes.

Because of the loose fit of control element 45 on pins 56 at the lower end of arm 55, the upper edge of control element 45 rests against surface 41 and the lower edge of control element 45 pivots away from surface 41 in open positions as illustrated. Cushion string 75 provides a slight friction between periphery 44 and surface 41 along the upper edge of control element 45 as it moves open and closed. This prevents metal-to-metal scrubbing as the upper periphery 44 moves slightly against surface 41 while the lower periphery 44 pivots open and closed. When a rush of inlet air pulls control element 45 fully closed, cushion string 75 at the lower corners of control element 45 softens the encounter with surface 41 and hushes an otherwise clapping noise that would occur as rim 44 strikes surface 41.

A comparision of the embodiments of FIGS. 1–5 and 6–8 suggests that many other arrangements of springs, pivots, control adjustments, and control element surfaces can be made to work for my control element. The embodiment of FIGS. 6–8 is presently preferred for simplicity, economy, and practical effectiveness; but variations can readily be made.

I claim:

1. A combustion air control for controlling the flow rate of a combustion air stream entering an inlet opening into an airtight stove or furnace containing a fire, said combustion air control comprising:

a. a control element having a peripheral rim movably arranged to engage a fixed surface around said inlet opening;

b. a pivoted arm supporting said control element for movement toward and away from said fixed surface;

c. a region of said control element within said peipheral rim being concave relative to said fixed surface so that said rim variably constricts the space available for combustion air flowing toward said inlet opening from ambient atmosphere outside said control element;

d. means for biasing said control element away from said fixed surface toward a maximum opening of said variable space between said peripheral rim and said fixed surface;

e. biasing means being non-linear and providing increasing resistance as said peripheral rim approaches said fixed surface; and f. said control element, biasing means, and fixed surface being arranged so that a variable pressure drop from outside to inside of said variable space constriction urges said control element against said non-linear biasing means to regulate air flow into said inlet opening.

2. The control of claim 1 including means for adjusting said biasing means to set said regulated flow rate at different values.

3. The control of claim 2 wherein said biasing means includes a plurality of springs arranged so that one of said springs biases said rim throughout its movement, and another of said springs biases said rim as it approaches said fixed surface.

4. The control of claim 3 wherein said springs are leaf springs movable with said control element and engaged by said adjusting means which is movable to change the bias force applied by said springs at different positions of said rim.

5. The control of claim 4 including means for cushioning the engagement of said rim with said fixed surface.

6. The control of claim 4 including a vertical arm pivotal on a horizontal axis with said control element being mounted on a lower end of said vertical arm for loose movement about a horizontal axis so that an upper region of said rim engages said fixed surface and slides relative to said fixed surface as a lower region of said rim moves toward said fixed surface.

7. The control of claim 6 wherein said rim has four corners, and a string looped over each of said corners cushions the engagement of said rim with said fixed surface.

8. The control of claim 1 wherein said biasing means is formed of a plurality of individually adjustable leaf springs.

9. The control of claim 8 wherein said leaf springs are movable with said control element and engaged by adjusting means which is movable to change the bias force applied by said springs at diffferent positions of said rim.

10. The control of claim 1 including means for cushioning the engagement of said rim with said fixed surface.

11. The control of claim 10 wherein said rim has four corners, and a string looped over each of said corners cushions the engagement of said rim with said fixed surface.

12. The control of claim 10 including means for adjusting said biasing means to set said regulated flow rate at different values.

13. The control of claim 12 including a vertical arm pivotal on a horizontal axis with said control element being mounted on a lower end of said vertical arm for loose movement about a horizontal axis so that an upper region of said rim engages said fixed surface and slides relative to said fixed surface as a lower region of said rim moves toward said fixed surface.

14. The control of claim 1 wherein said rim is formed as a thin edge.

15. The control of claim 1 wherein a mount loosely supports said control element on said pivot arm below the center of gravity of said control element so that an upper region of said rim engages said fixed surface and slides relative to said fixed surface as a lower region of said rim moves toward said fixed surface.

16. The control of claim 15 wherein said rim has four corners, and a string looped over each of said corners cushions the engagement of said rim with said fixed surface.

* * * * *